US009416993B2

(12) United States Patent
Hong

(10) Patent No.: US 9,416,993 B2
(45) Date of Patent: Aug. 16, 2016

(54) AIR CONDITIONER

(75) Inventor: Youngtaek Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 841 days.

(21) Appl. No.: 13/426,924

(22) Filed: Mar. 22, 2012

(65) Prior Publication Data

US 2013/0105118 A1 May 2, 2013

(30) Foreign Application Priority Data

Oct. 27, 2011 (KR) ..... 10-2011-0110253

(51) Int. Cl.
*F25B 13/00* (2006.01)
*F25B 6/00* (2006.01)

(52) U.S. Cl.
CPC . *F25B 13/00* (2013.01); *F25B 6/00* (2013.01); *F25B 2313/0252* (2013.01); *F25B 2313/02741* (2013.01)

(58) Field of Classification Search
CPC ..... F25B 2313/025; F25B 2313/02521; F25B 2313/02523; F25B 2313/02531; F25B 2313/02533; F25B 41/06; F25B 2313/02532; F25B 2313/0272; F25B 2313/02741; F25B 2313/02543; F25B 2313/02541
USPC ..... 165/96, 100, 101, 103; 62/196.4, 198, 62/199, 498, 160
See application file for complete search history.

(56) References Cited

U.S. PATENT DOCUMENTS 2,148,415 A * 2/1939 Labberton ..... 62/160
4,057,976 A * 11/1977 del Toro et al. ..... 62/324.1
4,173,865 A * 11/1979 Sawyer ..... F24F 11/085 62/160
4,240,269 A * 12/1980 Bussjager ..... 62/324.6
4,262,493 A * 4/1981 Lackey et al. ..... 62/324.6
4,306,421 A * 12/1981 Gucwa et al. ..... 62/324.1
2002/0194857 A1* 12/2002 Kato et al. ..... 62/185
2003/0230096 A1* 12/2003 Hwang, II ..... 62/160
2006/0162353 A1* 7/2006 Ha et al. ..... 62/149
2009/0272135 A1* 11/2009 Nishimura et al. ..... 62/149

FOREIGN PATENT DOCUMENTS

CN 1477344 A 2/2004
CN 101514855 A 8/2009

(Continued)

OTHER PUBLICATIONS

Korean Office Action dated Jan. 18, 2013.

(Continued)

*Primary Examiner* — Tho V Duong
(74) *Attorney, Agent, or Firm* — KED & Associates, LLP

(57) ABSTRACT

An air conditioner is provided. The air conditioner may include at least one indoor device and an outdoor device connected to the at least one indoor device. The outdoor device may include an outdoor heat exchanger including a plurality of heat exchange parts, a plurality of outdoor expansion parts corresponding to the plurality of heat exchange parts, a pass variable tube that varies refrigerant flow in the outdoor heat exchanger, and a pass variable valve provided in the pass variable tube. The heat exchange parts may include a first heat exchange part. The first heat exchange part may be connected to a manifold that distributes refrigerant flow in a heating operation. The manifold may be connected to a plurality of capillaries connected to the first outdoor expansion part. The pass variable tube may be connected to the manifold.

27 Claims, 3 Drawing Sheets

(56) References Cited

FOREIGN PATENT DOCUMENTS

| | | | | |
|---|---|---|---|---|
| CN | 2013-06902 | Y | | 9/2009 |
| EP | 1655555 | A3 | * | 8/2011 |
| JP | 09-126595 | | | 5/1997 |
| JP | 2000-146258 | A | | 5/2000 |
| JP | 2002-156167 | | | 5/2002 |
| JP | 2002156167 | A | * | 5/2002 |
| KR | 10-2005-0118450 | | | 12/2005 |
| KR | 10-0741871 | | | 7/2007 |

OTHER PUBLICATIONS

Korean Office Action dated Jul. 9, 2013.

Chinese Office Action dated Dec. 3, 2014, issued in Application No. 201210110821.1 (with English Translation).

* cited by examiner

AIR CONDITIONER

CROSS-REFERENCE TO RELATED APPLICATION(S)

The present application claims priority under 35 U.S.C. 119 and 35 U.S.C. 365 to Korean Patent Application No. 10-2011-0110253, filed in Korea on Oct. 27, 2011, which is hereby incorporated by reference in its entirety.

BACKGROUND

1. Field

An air conditioner is disclosed herein.

2. Background

Air conditioners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
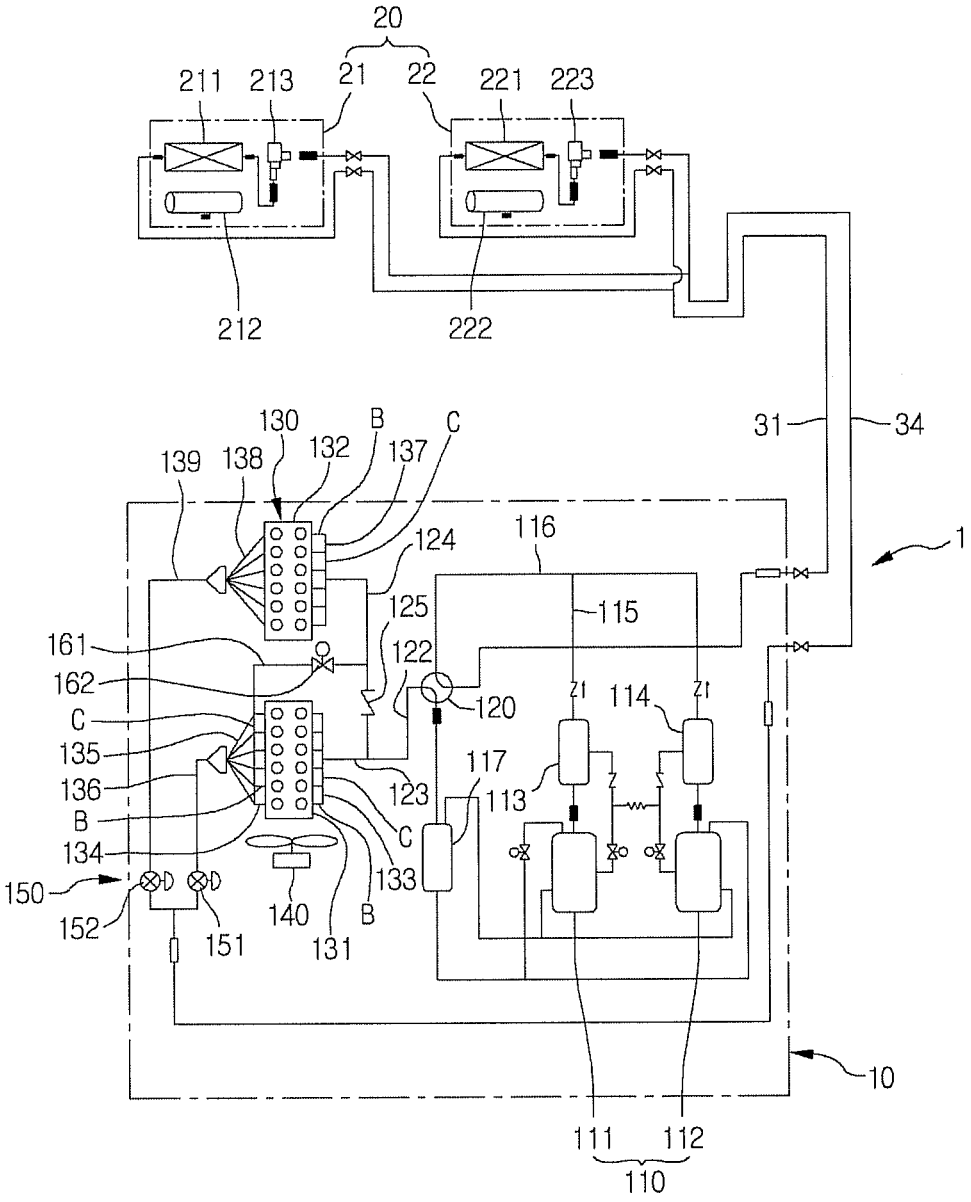
FIG. 1 is a schematic diagram of a refrigerant cycle of an air conditioner according to an embodiment.

Hereinafter, embodiments will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions has been omitted.

Also, in the description of embodiments, terms such as first, second, A, B, (a), or (b), for example, may be used herein when describing components of the present invention. Each of these terminologies is not used to define an essence, order, or sequence of a corresponding component, but used merely to distinguish the corresponding component from other component(s). It should be noted that if it is described in the specification that one component is "connected," "coupled," or "joined" to another component, the former may be directly "connected," "coupled," and "joined" to the latter or "connected," "coupled," and "joined" to the latter via another component.

Air conditioners may include a refrigerant cycle including a compressor, a condenser, an expansion mechanism, and an evaporator that heats/cools an indoor space or purifies air. Air conditioners may be classified as a single type air conditioner, in which a single indoor unit or device is connected to a single outdoor unit or device, or a multi-type air conditioner, in which a plurality of indoor units or devices is connected to a single outdoor or device to provide the effect of a plurality of air conditioners.

FIG. 1 is a schematic diagram of a refrigerant cycle of an air conditioner according to an embodiment. Referring to FIG. 1, an air conditioner 1 according to this embodiment may include an outdoor device 10 and an indoor device 20 connected to the outdoor device 10 through refrigerant tubes.

The indoor device 20 may include a plurality of indoor devices 21 and 22. Although one outdoor device is shown connected to two indoor devices herein for convenience in description, embodiments are not limited to this number of outdoor and indoor devices. For example, two or more indoor devices may be connected to two or more outdoor devices.

The outdoor device 10 may include a compression device 110 that compresses refrigerant, and an outdoor heat exchanger 130, in which outdoor air exchanges heat with the refrigerant. The compression device 110 may include one or more compressors. For example, the compression device 110 may include a plurality of compressors 111 and 112. The compressors 111 and 112 may include an inverter compressor having a variable capacity, and a constant-speed compressor. Alternatively, the compressors 111 and 112 may all be inverter compressors or constant-speed compressors. The compressors 111 and 112 may be arranged in parallel. At least one portion of the compressors 111 and 112 may operate according to a capacity of the indoor device 20.

Discharge tubes of the compressors 111 and 112 may include individual tubes 115 and a joint tube 116. That is, the individual tubes 115 of the compressors 111 and 112 may join or be jointed to the joint tube 116. The individual tubes 115 may be provided with oil separators 113 and 114 that separate oil from the refrigerant. Oil separated from the refrigerant by the oil separators 113 and 114 may be recovered to the compressors 111 and 112.

The joint tube 116 may be connected to a valve 120, which may be a four-way valve, that switches refrigerant flow. The valve 120 may be connected to the outdoor heat exchanger 130 through a connecting tube. The connecting tube may include a common connection tube 122, a first connection tube 123, and a second connection tube 124. The valve 120 may be connected to an accumulator 117, which may be connected to the compression device 110.

The outdoor heat exchanger 130 may include a first heat exchange part 131 and a second heat exchange part 132. The first and second heat exchange parts 131 and 132 may be separate heat exchangers, or a single outdoor heat exchanger divided into the first and second heat exchange parts 131 and 132 according to refrigerant flow. The first and second heat exchange parts 131 and 132 may be disposed horizontally or vertically. The first and second heat exchange parts 131 and 132 may have different or the same heat exchange capacity. The first heat exchange part 131 may communicate with the first connection tube 123, and the second heat exchange part 132 may communicate with the second connection tube 124.

The second connection tube 124 may be provided with a check valve 125 that allows the refrigerant to flow only in one direction. The check valve 125 may allow the refrigerant discharged from the second heat exchange part 132 to flow from the common connection tube 122 through the second connection tube 124.

A first manifold 133 may be connected to a side of the first heat exchange part 131, and a second manifold 134 may be connected to another side of the first heat exchange part 131. The first manifold 133 may distribute the refrigerant to the first heat exchange part 131 when the air conditioner 1 is in a cooling operation. The second manifold 134 may distribute the refrigerant to the first heat exchange part 131 when the air conditioner 1 is in a heating operation.

Each of the first and second manifolds 133 and 134 may include a common tube (no reference number) and a plurality of branch tubes (no reference number). The branch tubes may be connected to refrigerant tubes of the first and second heat exchange parts 131 and 132. As the first and second manifolds 133 and 134 may have a well-known structure, a detailed description thereof has been omitted.

The first connection tube 123 may be connected to the common tube of the first manifold 133. First capillaries 135 may be connected to the second manifold 134. The first capillaries 135 may uniformly divide the refrigerant flow when the air conditioner 1 is in the heating operation. Then, the divided refrigerant may be introduced to the second manifold 134, and distributed to the first heat exchange part 131. The first capillaries 135 may be connected to the common tube of the second manifold 134, or to the branch tubes, respectively. In this case, the number of the branch tubes may be equal to the number of the first capillaries 135.

A third manifold 137 may be connected to a side of the second heat exchange part 132, and second capillaries 138 may be connected to another side of the second heat exchange part 132. The third manifold 137 may distribute the refrigerant to the second heat exchange part 132 when the air conditioner 1 is in the cooling operation. The second capillaries 138 may uniformly divide the refrigerant flow when the air conditioner 1 is in the heating operation.

A pass variable tube 161 may be connected to the second connection tube 124 and the second manifold 134. The pass variable tube 161 may be provided with a pass variable valve 162. The pass variable valve 162 may be a solenoid valve; however, embodiments are not limited thereto.

The pass variable tube 161 may be connected to the common tube of the second manifold 134, or to one of the branch tubes thereof. The pass variable tube 161 may be connected to the second connection tube 124 between the check valve 125 and the third manifold 137.

The pass variable tube 161 and the pass variable valve 162 may vary refrigerant flow within the outdoor heat exchanger 130. The pass variable tube 161 and the pass variable valve 162 may control the refrigerant to simultaneously flow to the first and second heat exchange parts 131 and 132 (that is, to flow in parallel thereto), or control the refrigerant to flow to one of the first and second heat exchange parts 131 and 132, and then, to the other. Alternatively, flows of the refrigerant under different conditions (for example, in temperature, in pressure, or in a state such as vapor and liquid states) may be introduced to the first and second heat exchange parts 131 and 132.

In the outdoor heat exchanger 130, the refrigerant may exchange heat with outdoor air blown by a fan motor assembly 140 that includes an outdoor fan and a fan motor. A plurality of fan motor assemblies 140 may be provided. The number of fan motor assemblies 140 provided may be equal in number to the number of the first and second heat exchange parts 131 and 132. One fan motor assembly 140 is shown in FIG. 1; however, embodiments are not limited thereto.

The outdoor device 10 may include an outdoor expansion mechanism 150. The outdoor expansion mechanism 150 does not expand the refrigerant discharged from the outdoor heat exchanger 130, bur rather, expands the refrigerant entering the outdoor heat exchanger 130.

The outdoor expansion mechanism 150 may include a first outdoor expansion valve 151 (or a first outdoor expansion part) connected to the first capillaries 135 through a third connection tube 136, and a second outdoor expansion valve 152 (or a second outdoor expansion part) connected to the second capillaries 138 through a fourth connection tube 139. Diameters of the third and fourth connection tubes 136 and 139 may be greater than diameters of the first and second capillaries 135 and 138. Diameters of the common tubes and branch tubes of the second and third manifolds 134 and 137 may be greater than diameters of the first and second capillaries 135 and 138.

The refrigerant expanded by the first outdoor expansion valve 151 may flow to the first heat exchange part 131. The refrigerant expanded by the second outdoor expansion valve 152 may flow to the second heat exchange part 132. The first and second outdoor expansion valves 151 and 152 may be electronic expansion valves (EEVs), for example.

The outdoor device 10 may be connected to the indoor device 20 through a gas tube 31 and a liquid tube 34. The gas tube 31 may be connected to the valve 120, and the liquid tube 34 may be connected to the outdoor expansion mechanism 150.

The indoor device 21 may include an indoor heat exchanger 211, an indoor fan 212, and an indoor expansion mechanism 213. The indoor device 22 may include indoor heat exchanger 221, an indoor fan 222, and an indoor expansion mechanism 223. The indoor expansion mechanisms 213 and 223 may be electronic expansion valves (EEVs), for example.

Hereinafter, cooling and heating operations of an air conditioner, and refrigerant flow during the cooling and heating operations will now be described according to this embodiment.

Figure 2:
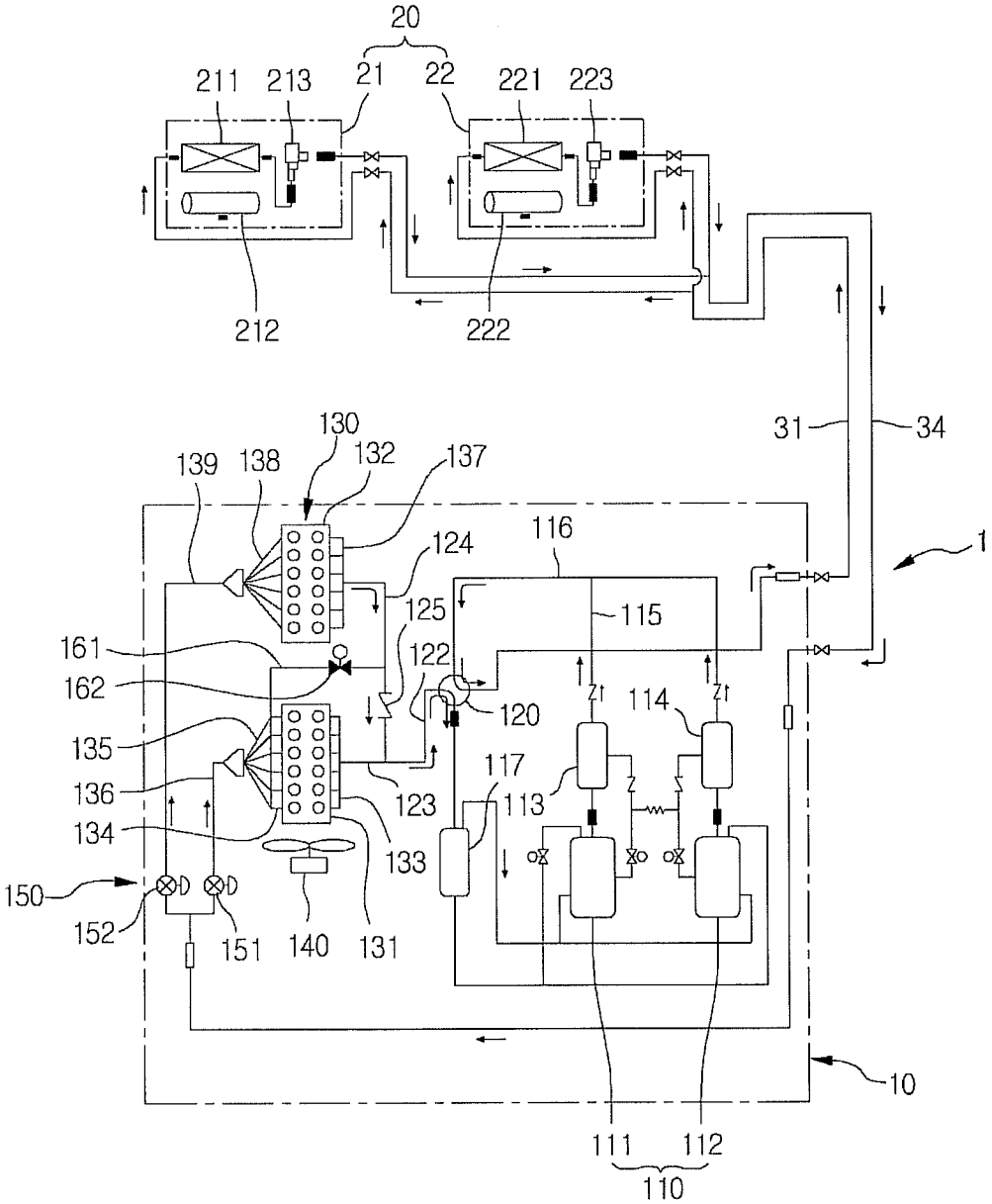
FIG. 2 is a schematic view diagram of refrigerant flow in a heating operation of an air conditioner according to an embodiment.

FIG. 2 is a schematic diagram of refrigerant flow in a heating operation of an air conditioner according to an embodiment. Referring to FIG. 2, when the air conditioner 1 performs a heating operation, the refrigerant discharged from the compression device 110 of the outdoor device 10 may flow to the indoor devices 21 and 22 along the gas tube 31 according to a passage control operation of the valve 120. Then, the refrigerant may be condensed in the indoor heat exchangers 211 and 221, and pass through the indoor expansion mechanisms 213 and 223, without expansion.

Then, the refrigerant may flow to the outdoor device 10 through the liquid tube 34. The refrigerant arriving at the outdoor device 10 may be expanded by the first and second outdoor expansion valves 151 and 152, and then, flow to the first and second heat exchange parts 131 and 132. When the air conditioner 1 performs the heating operation, the pass variable valve 162 may be closed.

More particularly, the refrigerant expanded by the first outdoor expansion valve 151 may flow through the third connection tube 136, and then, may be distributed by the first capillaries 135. Thus, the refrigerant from the third connection tube 136 may be evenly distributed by the first capillaries 135, and depressurized in the first capillaries 135. Further, the pressure of the refrigerant discharged from the first outdoor expansion valve 151 may be decreased by the first capillaries 135, to thereby improve heating performance.

Next, the refrigerant may be introduced to the second manifold 134. At this point, when the first capillaries 135 are connected to the common tube 136 of the second manifold 134, the refrigerant discharged from the first capillaries 135 may be introduced to the common tube 136 of the second manifold 134, then, flow through the branch tubes, and then, through the first heat exchange part 131. Because the pass variable valve 162 is closed, the refrigerant introduced to the second manifold 134 may be prevented from flowing through the pass variable tube 161.

The refrigerant may be evaporated in the first heat exchange part 131, and then, flow of the evaporated refrigerant may be joined in the first manifold 133, and introduced to the first connection tube 123. The refrigerant expanded by the second outdoor expansion valve 152 may flow through the fourth connection tube 139, and then, may be distributed by the second capillaries 138. Thus, the refrigerant from the fourth connection tube 139 may be evenly distributed by the second capillaries 138, and then, flow to the second heat exchange part 132. The refrigerant may be evenly distributed to the second heat exchange part 132 through the second capillaries 138, and may be depressurized by the second capillaries 138, to thereby improve heating performance.

The refrigerant may be evaporated in the second heat exchange part 132, and then, flow of the evaporated refrigerant may be joined in the third manifold 137, and introduced to the second connection tube 124. At this point, because the pass variable valve 162 is closed, the refrigerant introduced to the second connection tube 124 may be prevented from flowing through the pass variable tube 161. The refrigerant discharged from the second connection tube 124 may pass through the check valve 125, then, may be introduced to the common connection tube 122 to join the refrigerant discharged from the first connection tube 123, and next, may be introduced to the accumulator 117 through the valve 120. Finally, vapor refrigerant of the refrigerant introduced to the accumulator 117 may be introduced to the compression device 110.

As such, when the air conditioner 1 performs the heating operation, the pass variable valve 162 may be closed, and the distributed refrigerant introduced to the first and second heat exchange parts 131 and 132. Accordingly, a passing amount of refrigerant increases to improve evaporating performance, thus, improving heating performance.

Figure 3:
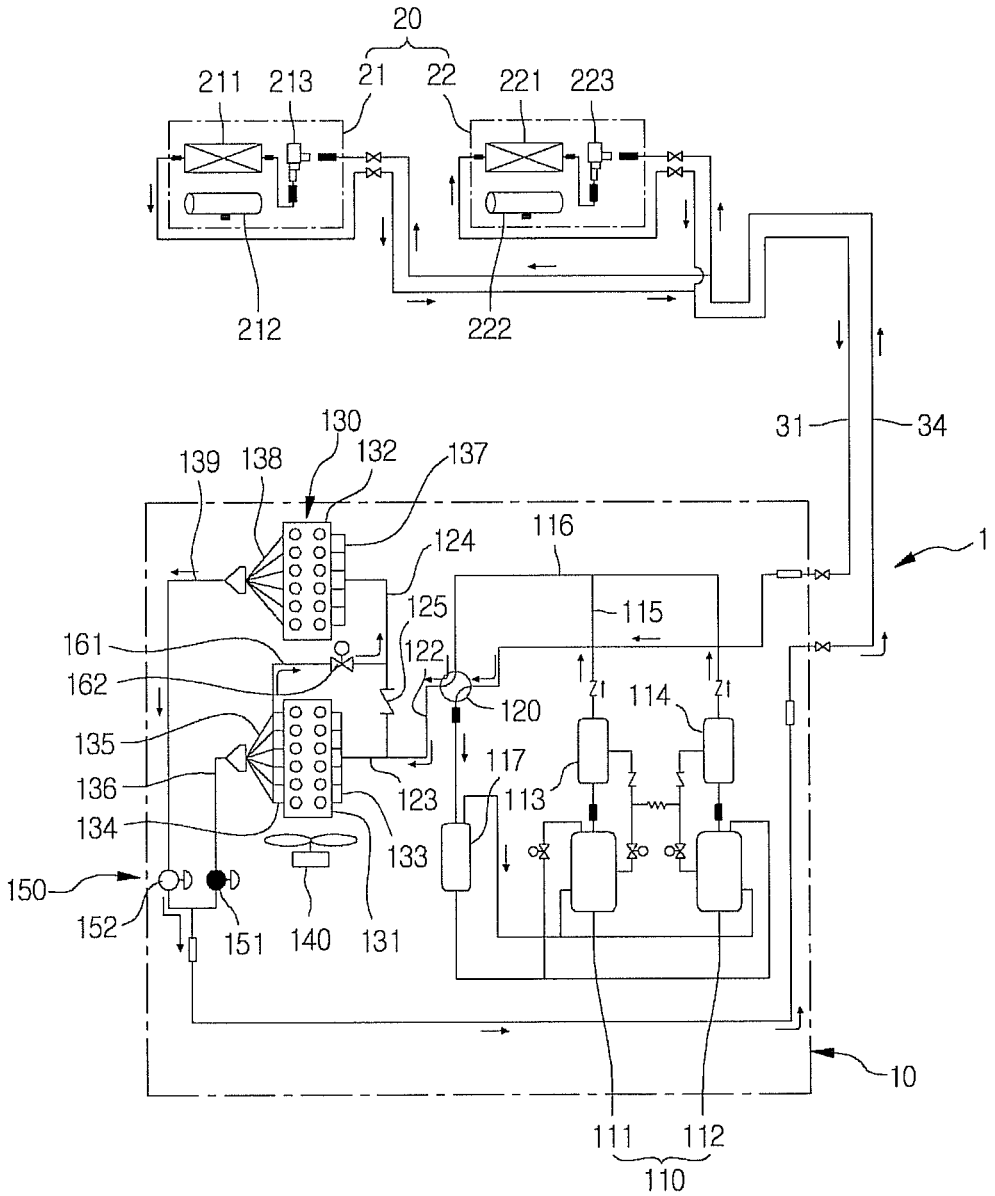
FIG. 3 is a schematic diagram of refrigerant flow in a cooling operation of an air conditioner according to an embodiment.

FIG. 3 is a schematic diagram of refrigerant flow in a cooling operation of an air conditioner according to an embodiment. Referring to FIG. 3, when the air conditioner 1 performs the cooling operation, the refrigerant compressed to a high temperature/high pressure state in the compression device 110 of the outdoor device 10 may flow to the outdoor heat exchanger 130 according to a passage control operation of the valve 120.

When the air conditioner 1 performs the cooling operation, the pass variable valve 162 may be opened, the first outdoor expansion valve 151 closed, and the second outdoor expansion valve 152 fully opened (a degree of opening is 100). More particularly, the refrigerant discharged from the common connection tube 122 may be introduced to the first manifold 133 through the first connection tube 123. However, the refrigerant discharged from the common connection tube 122 may not pass through the check valve 125 of the second connection tube 124.

The refrigerant introduced to the first manifold 133 may be distributed to the first heat exchange part 131 by the first manifold 133. The refrigerant may be condensed in the first heat exchange part 131, and then flow to the second manifold 134. At this point, the first outdoor expansion valve 151 may be closed, and the pass variable tube 161 opened. Thus, the refrigerant discharged from the second manifold 134 may flow to the pass variable tube 161, without flowing to the first capillaries 135. Then, the refrigerant may be introduced to the third manifold 137. The refrigerant introduced to the third manifold 137 may be distributed to the second heat exchange part 132 by the third manifold 137. The refrigerant may be condensed in the second heat exchange part 132, and then flow to the second capillaries 138. Then, the refrigerant may flow through the fourth connection tube 139, and then pass through the second outdoor expansion valve 152, without expansion. After that, the refrigerant may be introduced to the indoor devices 21 and 22 through the liquid tube 34.

The refrigerant introduced to the indoor devices 21 and 22 may be expanded by the indoor expansion mechanisms 213 and 223, and then, may be introduced to the indoor heat exchangers 211 and 221. The refrigerant may be evaporated in the indoor heat exchangers 211 and 221, and then, flow to the outdoor device 10 through the gas tube 31. Next, the refrigerant may be introduced to the accumulator 117 through the valve 120. Vapor refrigerant of the refrigerant introduced to the accumulator 135 may be introduced to the compression device 110.

As such, when the air conditioner 1 performs the cooling operation, the refrigerant may sequentially flow through the first and second heat exchange parts 131 and 132. Accordingly, a flowing length of the refrigerant increases, and thus, condensing performance of the refrigerant may be improved. That is, a heat exchange time and area of the refrigerant may be increased, to thereby may improve condensing performance, thus improving cooling performance.

In addition, as the refrigerant discharged from the first heat exchange part 131 flows through the pass variable tube 161, without passing through the first capillaries 135, pressure loss of the refrigerant discharged from the first heat exchange part 131 may be prevented.

The pass variable tube 161 may be a separate part from the second manifold 134, or may be a part thereof. That is, the second manifold 134 may include the pass variable tube 161.

The number of the first and second heat exchange parts 131 and 132 shown forming the outdoor heat exchanger 130 is two; however, embodiments are not limited thereto.

Embodiments disclosed provide an air conditioner. An air conditioner according to embodiments disclosed herein may include an indoor device, and an outdoor device connected to the indoor device. The outdoor device may include an outdoor heat exchanger including heat exchange parts; a plurality of outdoor expansion parts corresponding to the heat exchange parts; a pass variable tube configured to vary refrigerant flow in the outdoor heat exchanger; and a pass variable valve provided to the pass variable tube. The heat exchange parts may include a first heat exchange part. The first heat exchange part may be connected to a manifold that distributes refrigerant flow in a heating operation. The manifold may be connected to capillaries connected to a first outdoor expansion part of the plurality of outdoor expansion parts, and the pass variable tube may be connected to the manifold.

Embodiments disclosed herein further provide an air conditioner that may include an indoor device, and an outdoor device connected to the indoor device. The outdoor device may include an outdoor heat exchanger; an outdoor expansion mechanism that communicates with the outdoor heat exchanger; a pass variable tube that varies refrigerant flow in the outdoor heat exchanger; and a pass variable valve provided to the pass variable tube. The outdoor heat exchanger may include a first heat exchange part and a second heat exchange part. The first heat exchange part may be connected to a first manifold and a second manifold to distribute refrigerant flow. The second manifold may be connected to capillaries, and the pass variable tube may be connected to the second manifold.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

at least one indoor device; and an outdoor device connected to the at least one indoor device, wherein the outdoor device comprises:

an outdoor heat exchanger comprising a plurality of heat exchange parts;

a plurality of outdoor expansion parts corresponding to the plurality of heat exchange parts, respectively;

a pass variable tube configured to vary refrigerant flow in the outdoor heat exchanger;

a pass variable valve provided in or on the pass variable tube, wherein the plurality of heat exchange parts comprises first and second heat exchange parts and the plurality of outdoor expansion parts comprises first and second outdoor expansion parts, wherein the first heat exchange part is connected to a manifold that distributes refrigerant flow in a heating operation, wherein the manifold is connected to capillaries connected to the first outdoor expansion part, and wherein the pass variable tube is connected to the manifold, a first connection tube in which refrigerant discharged from the first heat exchange part flows in the heating operation; and a second connection tube in which refrigerant discharged from the second heat exchange part flows in the heating operation, wherein the pass variable tube is connected to the second connection tube, wherein a check valve is provided in or on the second connection tube that allows the refrigerant to flow only in one direction, and the pass variable tube is connected to the second connection tube between the check valve and the second heat exchange part.

2. The air conditioner according to claim 1, wherein the manifold comprises:

a common tube; and a plurality of branch tubes, wherein the pass variable tube is connected to one of the common tube or the plurality of branch tubes.

3. The air conditioner according to claim 1, wherein the refrigerant discharged from the second heat exchange part passes through the check valve.

4. The air conditioner according to claim 1, wherein the manifold comprises:

a common tube; and a plurality of branch tubes, wherein the capillaries are connected to the common tube.

5. The air conditioner according to claim 1, wherein the manifold comprises:

a common tube; and a plurality of branch tubes, wherein the number of the capillaries is equal to the number of the plurality of branch tubes, and wherein the capillaries are connected to the plurality of branch tubes, respectively.

6. The air conditioner according to claim 1, wherein, in the heating operation, the pass variable valve is closed, and refrigerant is divided to flow to the plurality of heat exchange parts.

7. The air conditioner according to claim 1, wherein, in a cooling operation, the pass variable valve is opened, and refrigerant sequentially flows through the first heat exchange part, the pass variable tube, and the second heat exchange part.

8. The air conditioner according to claim 7, wherein, in the cooling operation, the first outdoor expansion part corresponding to the first heat exchange part is closed.

9. An air conditioner, comprising:

at least one indoor device; and an outdoor device connected to the at least one indoor device, wherein the outdoor device comprises:

an outdoor heat exchanger;

an outdoor expansion mechanism that communicates with the outdoor heat exchanger;

a pass variable tube that varies refrigerant flow in the outdoor heat exchanger;

a pass variable valve provided in or on the pass variable tube, wherein the outdoor heat exchanger comprises a first heat exchange part and a second heat exchange part, wherein the first heat exchange part is connected to a first manifold and a second manifold that distribute refrigerant flow, wherein the second manifold is connected to a plurality of capillaries, and wherein the pass variable tube is connected to the second manifold, the first manifold is connected to a valve, and the plurality of capillaries is connected to the outdoor expansion mechanism;

a first connection tube in which refrigerant discharged from the first heat exchange part flows in a heating operation; and a second connection tube in which refrigerant discharged from the second heat exchange part flows in the heating operation, wherein the pass variable tube is connected to the second connection tube, wherein the second connection tube is provided with a check valve that allows the refrigerant to flow only in one direction, and wherein the pass variable tube is connected to the second connection tube between the check valve and the second heat exchange part.

10. The air conditioner according to claim 9, wherein the valve comprises a four-way valve.

11. The air conditioner according to claim 9, wherein one side of the second heat exchange part is connected to a third manifold connected to the second connection tube, and wherein another side thereof is connected to a plurality of capillaries connected to the outdoor expansion mechanism.

12. The air conditioner according to claim 9, wherein, in the heating operation, the pass variable valve is closed, and refrigerant is divided to flow to the first and second heat exchange parts, and wherein the refrigerant discharged from the second heat exchange part passes through the check valve.

13. The air conditioner according to claim 9, wherein the second manifold comprises:

a common tube; and a plurality of branch tubes, wherein the pass variable tube is connected to one of the common tube or the plurality of branch tubes.

14. The air conditioner according to claim 9, wherein, in a cooling operation, the pass variable valve is opened, and refrigerant sequentially flows through the first heat exchange part, the pass variable tube, and the second heat exchange part.

15. The air conditioner according to claim 14, wherein the outdoor expansion mechanism comprises:

a first outdoor expansion part corresponding to the first heat exchange part; and a second outdoor expansion part corresponding to the second heat exchange part; wherein, in the cooling mode, the first outdoor expansion part is closed, and the second outdoor expansion part is fully opened.

16. An air conditioner comprising:

at least one indoor unit; and an outdoor unit connected to the at least one indoor unit, wherein the outdoor unit comprises:

first and second heat exchangers, a first manifold coupled to the first heat exchanger;

a first valve provided between the first and second heat exchangers;

a first tube coupling the first manifold to the first valve and coupling the first valve to the second heat exchanger; and a second valve coupled to the first tube, wherein when operating both the first and second heat exchangers as a condenser to cool at least one indoor space, the first valve is configured to be opened to allow passage of refrigerant from the first heat exchanger to the second heat exchanger through the first manifold and the first tube, and the second valve prevents flow of refrigerant from the first valve to the first heat exchanger and wherein when operating both the first and second heat exchangers as an evaporator to heat at least one indoor space, the first valve is configured to be closed to allow passage of refrigerant through the first manifold and the first heat exchanger, and the second heat exchanger, and the second valve allows flow of refrigerant from the second heat exchanger.

17. The air conditioner of claim 16, further comprising a first expansion valve coupled to the first manifold of the first heat exchanger and a second expansion valve coupled to the second heat exchanger, wherein the first expansion valve is configured to be closed and the second expansion valve is configured to be opened during the cooling operation, and the first and second expansion valves are configured to be opened during the heating operation.

18. The air conditioner of claim 16, wherein the further comprising a second manifold, the second manifold configured to distribute refrigerant provided into the first heat exchanger during the cooling operation and configured to provide refrigerant out of the first heat exchanger during the heating operation.

19. The air conditioner of claim 18, further comprising a third manifold provided to the second heat exchanger, the third manifold configured to distribute refrigerant flowing through the first tube into the second heat exchanger during the cooling operation and configured to provide refrigerant out of the second heat exchanger during the heating operation.

20. The air conditioner of claim 16, further comprising a first capillary coupled to the first manifold, and a second capillary coupled to the second heat exchanger.

21. The air conditioner of claim 18, wherein the second valve is a check valve having an input port coupled to the first valve and an output port coupled to a second manifold that is coupled to the second heat exchanger.

22. The air conditioner of claim 21, further comprising a third valve coupled to the output port of the check valve and the second manifold, wherein during the cooling operation, refrigerant is provided through the third valve to the second manifold, and the check valve is configured to prevent flow of refrigerant from the third valve to the third manifold.

23. The air conditioner of claim 22, wherein during the heating operation, the check valve is configured to allow flow of refrigerant out of the third manifold to the third valve.

24. The air conditioner of claim 20, wherein the first manifold comprises a common tube and a plurality of branch tubes, the first capillary being coupled to one of the common tube and the plurality of branch tubes.

25. The air conditioner of claim 16, wherein the second valve is a check valve allowing flow of refrigerant in a single direction.

26. The air conditioner of claim 22, further comprising:

a first oil separator coupled to a first compressor;

a second oil separator coupled to a second compressor, the first oil separator and the first compressor coupled to the second oil separator and the second compressor in parallel and coupled to the third valve; and an accumulator coupled to the first and second compressors and the third valve.

27. The air conditioner of claim 26, wherein the third valve is a four way valve.

* * * * *